US005790147A

United States Patent [19]

Hensel

[11] Patent Number: 5,790,147

[45] Date of Patent: Aug. 4, 1998

[54] METHOD OF CLEANING AN INK JET HEAD

[75] Inventor: John M. Hensel, Kansas City, Kans.

[73] Assignee: Laser Cycle, Inc., Lenexa, Kans.

[21] Appl. No.: 700,233

[22] Filed: Aug. 20, 1996

[51] Int. Cl.[6] ..... B41J 2/165

[52] U.S. Cl. ..... 347/28; 347/23; 347/49

[58] Field of Search ..... 347/22, 23, 29, 347/30, 33, 28, 102, 84, 85, 86, 87, 49, 19

[56] References Cited

U.S. PATENT DOCUMENTS

| | | | |
|---|---|---|---|
| 3,839,721 | 10/1974 | Chen et al. | 347/28 |
| 4,746,938 | 5/1988 | Yamamori et al. . | |
| 4,814,794 | 3/1989 | Sato . | |
| 4,959,662 | 9/1990 | Kobayashi . | |
| 4,970,535 | 11/1990 | Oswald et al. . | |
| 5,103,244 | 4/1992 | Gast et al. | 347/33 |
| 5,300,958 | 4/1994 | Burke et al. . | |

FOREIGN PATENT DOCUMENTS

| | | | |
|---|---|---|---|
| 58-31757 | 2/1983 | Japan | 347/28 |
| 58-168569 | 10/1983 | Japan | 347/28 |
| 59-209150 | 11/1984 | Japan | 347/29 |
| 62-113560 | 5/1987 | Japan | 347/23 |
| 1-71756 | 3/1989 | Japan | 347/102 |

*Primary Examiner*—John E. Barlow, Jr.

*Attorney, Agent, or Firm*—Hovey,Williams, Timmons & Collins

[57] ABSTRACT

The present invention is directed toward a method of cleaning an ink jet cartridge assembly, and an apparatus for use in such a method. The method broadly includes the steps of providing a source of steam, and positioning the ink jet cartridge assembly adjacent to the source of steam. When the cartridge assembly is positioned adjacent to the source of steam, nozzle openings formed through a nozzle plate of the assembly are exposed to the steam for cleaning the openings. The steam assists in softening sediments and other material deposited in and around the nozzle openings so that the sediments may be removed from the nozzle plate. The invention also comprises, in combination, an ink jet cartridge assembly including a nozzle plate having a plurality of openings formed therethrough, and a source of steam. The cartridge assembly is operatively positioned adjacent to the source of steam so that the openings of the nozzle plate are exposed to the steam for cleaning the openings.

9 Claims, 2 Drawing Sheets

Fig. 2.
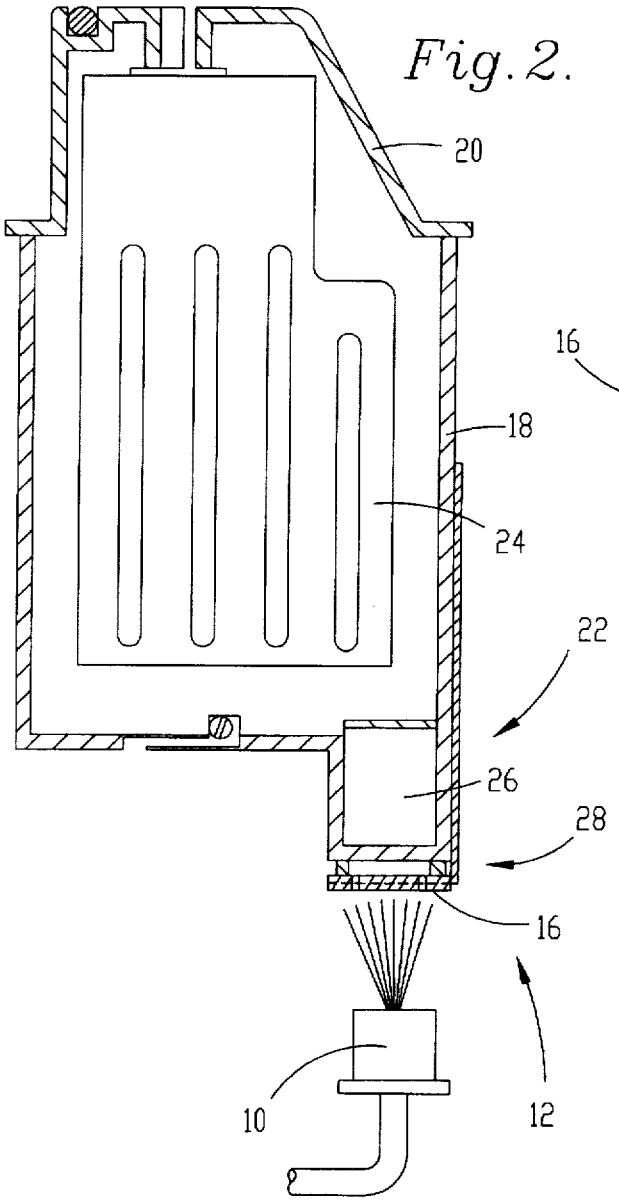
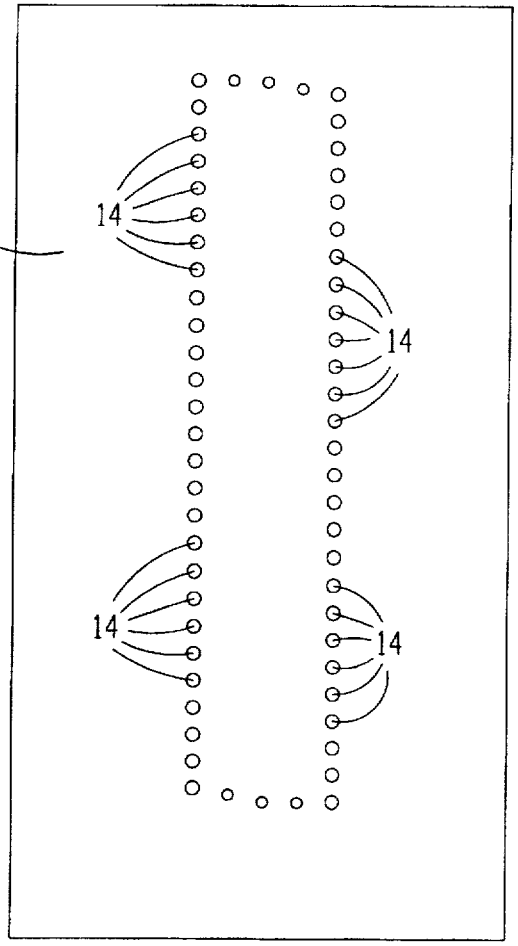
Fig. 3.
Fig. 4.
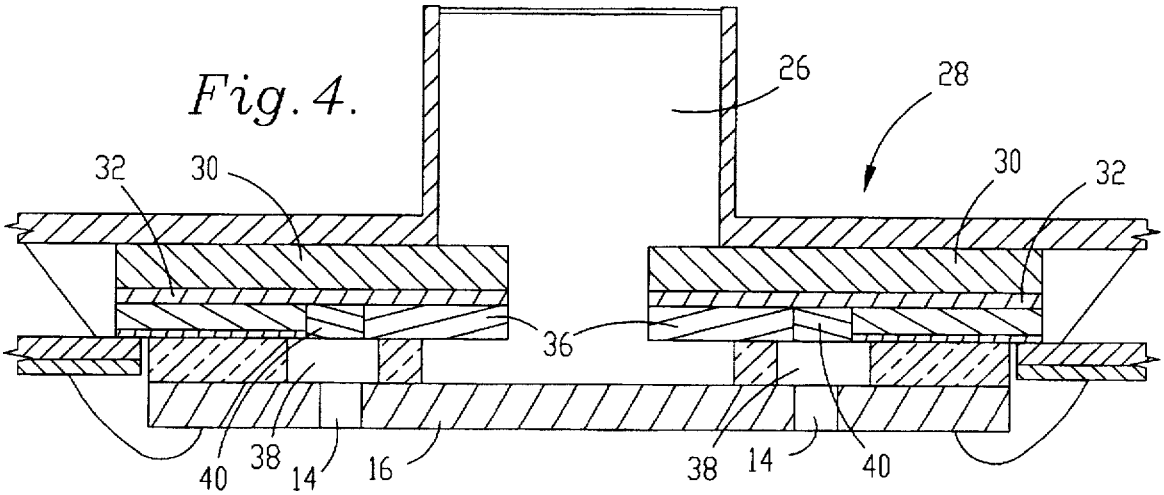

METHOD OF CLEANING AN INK JET HEAD

BACKGROUND OF THE INVENTION

1. Field of the Invention

The present invention relates to cleaning an ink jet head assembly of an ink jet cartridge assembly. More particularly, the invention relates to removing sediments and other material deposited in and around openings formed through a nozzle plate of the head assembly using steam.

2. Description of the Prior Art

Ink jet recording assemblies have been used for decades to record indicia on a recording medium, such as paper. A typical ink jet recording assembly broadly includes a printer unit and an ink jet cartridge assembly operatively coupled with the printer unit. The cartridge assembly contains a quantity of ink for printing the indicia. In use, the printer unit receives a piece of paper and causes the cartridge assembly to move transversely across the paper between an extended position and a retracted, parked position to print ink on the paper in the form of indicia.

Ink jet cartridge assemblies commonly include a body having an ink reservoir, and a head assembly. The head assembly includes an integrated circuit heater, a plurality of ink cups, and a plurality of nozzle openings formed through a nozzle plate. The nozzle openings are positioned beneath the ink cups for printing indicia.

A cartridge assembly manufactured by Hewlett-Packard under the product number HP 51626A includes a gold-plated nozzle plate about 0.02" thick having 54 nozzle openings and an additional six bleed air openings. The nozzle openings have a diameter of about 45 μm. The bleed air openings permit ink to be drawn into the head assembly and to the ink cups during use. The ink cups are configured retain the ink by surface tension to prevent leakage of the ink through the nozzle openings.

The integrated circuit heater includes resistors positioned within the ink cups. The resistors are coupled with a source of electric energy and are kept at an EMF of about 24 VDC. The ink cups retain the ink by surface tension until the source of electric energy causes the EMF to drop to about 12 VDC, which then causes the current to increase, heating the resistors. As the resistors are heated, the ink in the ink cups boils and is ejected through the nozzle openings for printing the indicia. The individual resistors may be selectively heated thousands of times per second for relatively precise ejection of ink resulting in relatively precise printing of indicia.

The process of heating and boiling the ink causes sediments and other material to become deposited in and around the nozzle openings and ink cups. As a result, the nozzle openings and ink cups eventually become sufficiently clogged so that the cartridge assembly is unusable. Dried ink is also deposited in and around the nozzle openings, clogging the openings.

Several devices are known which inhibit the clogging of the nozzle openings. For example, it is known to provide a head washing device mounted on a printer unit for spraying water on the nozzle plate when the cartridge assembly is in the retracted, parked position. By washing the nozzle plate after each use, sediments and other deposited material are removed from the nozzle openings, increasing the operational life of the cartridge assembly. A cleaning solution has also been used to clean a nozzle plate when the cartridge assembly is in the parked position.

Another known method of cleaning a nozzle plate involves the use of gas such as air or nitrogen gas. Such gas is directed tangentially to the face of the nozzle plate once the cartridge assembly has returned to the parked position. The gas carries sediments and other deposited material away from the nozzle plate, thus increasing the operational life of the cartridge assembly.

It is also known to provide a print head wiper positioned adjacent to the parked position of the cartridge assembly. As the cartridge assembly is returned to the parked position, the wiper removes sediment and other deposited material from the nozzle plate.

Once a cartridge assembly has reached the end of its operational life, either due to clogging of the nozzle openings or emptying of the ink reservoir, the cartridge assembly is removed from the printer unit and replaced by a fresh cartridge assembly. The spent cartridge assembly may then be returned to the manufacturer for recycling.

In a typical recycling process, the ink reservoir is emptied of any remaining ink, and the assembly is cleaned. Even when a cartridge assembly is used in conjunction with a head washing or cleaning device, some amount of sediment and other material will become deposited in and around the nozzle openings and ink cups during the operation of the cartridge assembly. Therefore, in a thorough recycling process, the nozzle plate is cleaned to unclog the nozzle openings.

One nozzle plate cleaning method includes the steps of positioning the plate in a cleaning solution for a short period of time, and wiping the plate to remove the sediments and other material. Once the nozzle plate is cleaned, the cartridge assembly is dried, refilled with ink and tested. Cartridge assemblies which do not meet certain predetermined standards of printing quality are discarded.

Although the cleaning solution causes some of the sediments and other material deposited in and around the nozzle openings to be removed, many nozzle openings and ink cups remain sufficiently clogged so that the cartridge assemblies must be discarded. As a result, there is a significant and heretofore unsolved need to provide an improved method and apparatus for cleaning the nozzle plate of an ink jet cartridge assembly to remove sediments and other material deposited in and around the nozzle openings of the nozzle plate.

SUMMARY OF THE INVENTION

The present invention addresses the prior art problems noted above and provides a significant advance in the state of the art of cleaning a nozzle plate of an ink jet cartridge assembly. The present invention includes a improved method of cleaning an ink jet cartridge assembly, and an apparatus for use in such a method.

The inventive method broadly includes the steps of providing a source of steam, and positioning an ink jet cartridge assembly adjacent to the source of steam. When so positioned, nozzle openings formed through a nozzle plate of the assembly are exposed to the steam for cleaning the openings. The steam assists in softening the sediments and other deposited material so that the sediments may be removed from the nozzle plate and ink cups.

The invention also comprises, in combination, an ink jet cartridge assembly including a nozzle plate having a plurality of openings formed therethrough, and a source of steam. The cartridge assembly is operatively positioned adjacent to the source of steam so that the openings of the nozzle plate are exposed to the steam for cleaning the openings.

DESCRIPTION OF THE DRAWING FIGURES

FIG. 2 is a cross-sectional view of the cartridge assembly of FIG. 1 positioned adjacent to a source of steam.

FIG. 3 is a plan view of a nozzle plate of the cartridge assembly.

FIG. 4 is a sectional view of an integrated circuit heater of the cartridge assembly.

DETAILED DESCRIPTION OF THE PREFERRED EMBODIMENT

Figure 1:
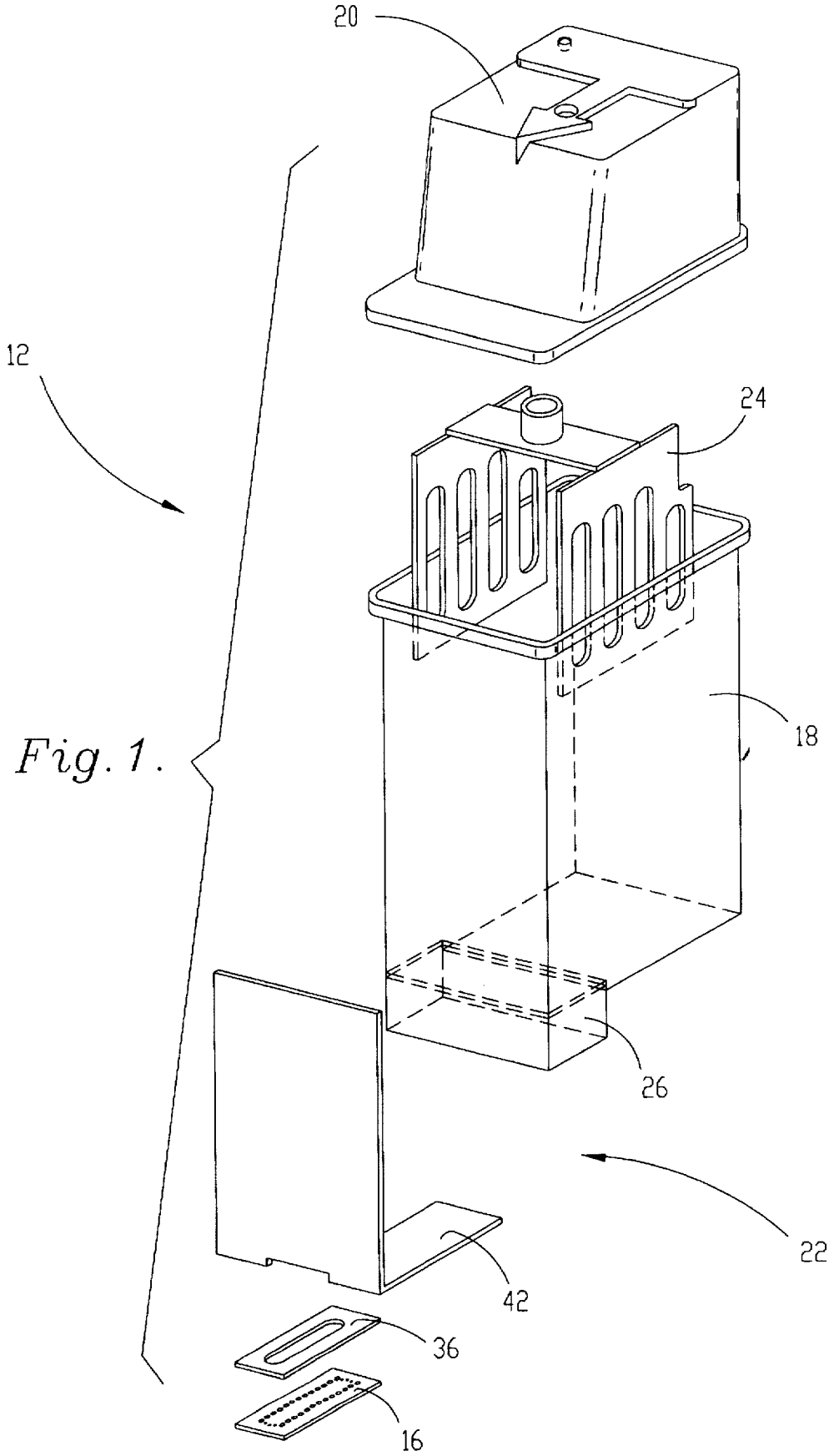
FIG. 1 is an exploded perspective view of an ink jet cartridge assembly.

Referring now to FIG. 2, the method of the present invention broadly includes the steps of providing a source 10 of high pressure steam, and positioning an ink jet cartridge assembly 12 adjacent to the source 10 of steam so that nozzle openings 14 formed through a nozzle plate 16 of the cartridge assembly 12 are exposed to the steam for cleaning the openings 14. Once the nozzle plate 16 has been exposed to the steam, the plate 16 is wiped with a damp cloth to remove sediments and other material deposited in and around the openings 14.

The source 10 of steam includes a body for retaining a quantity of fluid, and a steam port for releasing a quantity of steam at a high pressure. The source 10 is configured for use with a heating element for heating the fluid to create the steam. In a preferred form, the source retains a quantity of water which is heated by the heating element until the water boils to create the steam. The steam is then released through the port for exposing the nozzle openings 14 of the cartridge assembly 12 to the steam.

The ink jet cartridge assembly 12 broadly includes a container body 18, cap 20 and head assembly 22. The cartridge assembly 12 is configured to be operatively coupled with a printer unit of an ink jet recording device for printing indicia on a recording medium, such as paper.

The container body 18 of the cartridge assembly 12 includes a bladder 24, and serves as an ink reservoir. The cap 20 is coupled with an upper end of the container body 18 to prevent spillage of the ink from the body 18.

As shown in FIG. 4, the head assembly 22 of the cartridge assembly 12 includes an ink well 26 in fluid communication with the container body 18. The ink well 26 and the container body 18 are separated by a screen. The screen prevents foreign matter in the ink from passing from the body 18 into the well 26.

The head assembly 22 also includes an integrated circuit heater 28 configured for selectively ejecting a quantity of the ink for printing, and a nozzle plate 16 mounted adjacent to the heater 28 for directing the ejected ink. The integrated circuit heater 28 includes a silicon base layer 30 mated with a semi-conductor material layer 32, a resistor layer 34, and a glass protective layer 36. The glass layer 36 includes 54 ink cups 38 etched therethrough for retaining ink received from the ink well 26. The ink is retained in the ink cups 38 by surface tension.

The resistor layer 34 includes a resistor 40 within each of the ink cups 38. The resistor layer 34 is conductively coupled with a flex foil circuit 42 mounted adjacent to the head assembly 22. When the cartridge assembly 12 is coupled with a printer unit, the flex foil circuit 42 is conductively coupled with a source of electricity.

In use, the electricity source causes the flex foil circuit 42 to selectively increase the current flowing through the resistors 40. As a result, the resistors 40 are heated, boiling the ink and ejecting the ink from the ink cups 38. The nozzle plate 16 is mounted to the head assembly 22 so that the nozzle openings 14 are adjacent to the ink cups 38. Therefore, when the resistors 40 are heated, the ink is ejected from the ink cups 38 and through the nozzle openings 14 for printing indicia.

Once an ink jet cartridge assembly 12 has exceeded its operational life, either through depletion of the ink in the container body 18, or due to clogging of the nozzle openings 14, the cartridge assembly 12 is removed from the printer unit and replaced by a fresh cartridge assembly 12. The spent cartridge assembly 12 is then recycled for reuse.

In the recycling process, the various components of the cartridge assembly 12 are separated from each other for cleaning, and any remaining ink in the container body 18 is removed. The cap 20 and container body 18 are washed in water and dried. The head assembly 22 is then positioned adjacent to a mixture of water, a cleaning solution and a wetting agent so that the nozzle plate 16 is submersed in the mixture. Once the nozzle plate 16 is removed from the mixture, the plate 16 is wiped dry to remove sediments, dried ink and other material deposited in and around the nozzle openings 14.

After the cartridge components have been cleaned, they are reassembled and the container body 18 is refilled with ink. The reassembled cartridge assembly 12 is then tested for printing quality. Cartridge assemblies 12 which do not test satisfactorily are removed and steam cleaned.

The steam cleaning process involves holding the cartridge assembly 12 adjacent to the source 10 of steam by hand so that the nozzle openings 14 are exposed to the steam. The steam under pressure loosens the sediments and other deposited material from the nozzle plate 16, and from in and around the nozzle openings 14. After the cartridge assembly 12 is removed from the steam source 10, the sediments and deposited material are removed from the nozzle plate 16 by wiping the plate 16 with a damp cloth. The nozzle plate 16 is then dried and retested for printing quality. The steam cleaning process should be conducted up to two more times should the cartridge assembly 12 keep failing the printing quality test. After the third failure, the cartridge assembly 12 should be discarded.

As a result of the present invention, the overall number of ink jet cartridge assemblies 12 which must be discarded during the recycling process is reduced relative to the known prior art. By reducing the number of discarded cartridge assemblies 12, the cost associated with recycling such assemblies 12 is also reduced.

The present invention has been described in accordance with the illustrated preferred method and embodiment. It is noted that variations and changes may be made and equivalents employed without departing from the scope of the invention as recited in the claims. For example, various devices may be used to position the cartridge assembly 12 adjacent to the source 10 of steam, such as a support stand.

What is claimed is:

1. A method of cleaning an ink jet head of an ink jet cartridge assembly used in an ink jet printer, the head including a nozzle plate having a plurality of ink nozzle openings defined therein, the assembly further including a container body, said method comprising the steps of:

(a) removing the cartridge assembly from the printer;

(b) after step (a), disassembling the cartridge assembly by separating the container body and ink jet head including the nozzle plate;

(c) cleaning the nozzle plate while separated from the container body, step (c) further including the step of exposing the nozzle openings of the nozzle plate to steam under pressure; and (d) reassembling the ink jet head including the nozzle plate with an ink-filled container body to form a cartridge assembly.

2. The method as set forth in claim 1, after step (d), testing the cartridge assembly and if the testing indicates insufficient cleaning of the nozzle openings, repeating steps (b) and (c).

3. The method as set forth in claim 2, including the steps of repeating steps (b) and (c) for a maximum of two more times and if said testing then indicates insufficient cleaning, disposing of the nozzle plate.

4. The method as set forth in claim 1, step (c) further including the step of submerging the nozzle plate in a solution of cleaning liquid prior to said exposing step.

5. The method as set forth in claim 4, step (c) further including the step of submerging the nozzle plate in a mixture of water, cleaning solution and wetting agent.

6. The method as set forth in claim 1, step (c) including the step of cleaning the container body and refilling with ink, and reassembling the container body so cleaned with the ink jet head in step (d).

7. The method as set forth in claim 1, step (c) further including the step of wiping the nozzle plate with a damp cloth after said exposing step.

8. The method as set forth in claim 1, after step (d), reinstalling the ink jet cartridge into the printer for use.

9. A method of cleaning an ink jet head of an ink jet cartridge assembly used in an ink jet printer, the head including a nozzle plate having a plurality of ink nozzle openings defined therein, the assembly further including a container body, said method comprising the steps of:

(a) removing the cartridge assembly from the printer;

(b) after step (a), disassembling the cartridge assembly by separating the container body and ink jet head including the nozzle plate;

(c) cleaning the nozzle plate and the container body while separated from one another, step (c) further including the steps of (c1) submerging the nozzle plate in a cleaning solution, (c2) exposing the nozzle openings of the nozzle plate to steam under pressure, (c3) after cleaning the container body, refilling the container body with ink;

(d) reassembling the ink jet head including the nozzle plate with an ink-filled container body to form a cartridge assembly;

(e) testing the cartridge assembly;

(f) if the testing indicates insufficient cleaning of the nozzle openings, repeating steps (b) and (c) for a predetermined number of times; and (g) if the testing indicates sufficient cleaning of the nozzle openings, reinstalling the cartridge assembly in a printer for use.

* * * * *